US012185895B2

(12) United States Patent
Lucas et al.

(10) Patent No.: US 12,185,895 B2
(45) Date of Patent: Jan. 7, 2025

(54) REMOVABLE BASKET FOR A DISHWASHING APPLIANCE

(71) Applicant: Haier US Appliance Solutions, Inc., Wilmington, DE (US)

(72) Inventors: Alan Stevenson Lucas, Louisville, KY (US); Arpit Singhal, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 655 days.

(21) Appl. No.: 17/505,806

(22) Filed: Oct. 20, 2021

(65) Prior Publication Data

US 2023/0123920 A1 Apr. 20, 2023

(51) Int. Cl.

| | |
|---|---|
| ***A47L 15/08*** | (2006.01) |
| ***A47L 15/16*** | (2006.01) |
| ***A47L 15/50*** | (2006.01) |

(52) U.S. Cl.

CPC ..... *A47L 15/507* (2013.01); *A47L 15/16* (2013.01); *A47L 15/505* (2013.01); *A47L 15/08* (2013.01)

(58) Field of Classification Search

None

See application file for complete search history.

(56) References Cited

U.S. PATENT DOCUMENTS

| | | | | |
|---|---|---|---|---|
| 2006/0078661 | A1 | 4/2006 | Wang | |
| 2009/0266383 | A1 * | 10/2009 | Wang | A47J 43/24 134/109 |
| 2014/0239783 | A1 | 8/2014 | Dordan | |
| 2016/0165947 | A1 | 6/2016 | Hoye | |

FOREIGN PATENT DOCUMENTS

| | | | |
|---|---|---|---|
| CN | 2296170 | Y | 11/1998 |
| CN | 101584559 | A | 11/2009 |
| CN | 105212794 | | 1/2016 |
| CN | 103932358 | B | 10/2017 |
| CN | 106073552 | B | 11/2018 |
| CN | 108784609 | A | 11/2018 |
| CN | 210158560 | U | 3/2020 |
| EP | 2005846 | A1 | 12/2008 |
| TW | 201312084 | A | 3/2013 |

* cited by examiner

*Primary Examiner* — Levon J Shahinian

(74) *Attorney, Agent, or Firm* — Dority & Manning, P.A.

(57) ABSTRACT

A basket is selectively receivable within a dishwashing appliance. The basket includes a plurality of vertically arranged receiving bosses that receive spray tines therein and a lid having a domed interior surface for dispersing liquid dispensed from the spray tines throughout the basket.

20 Claims, 10 Drawing Sheets

REMOVABLE BASKET FOR A DISHWASHING APPLIANCE

FIELD OF THE INVENTION

The present subject matter relates generally to dishwashing appliances, and more particularly to removable baskets for dishwashing appliances.

BACKGROUND OF THE INVENTION

Dishwashing appliances generally include a tub that defines a wash chamber for receipt of articles for washing. Certain dishwashing appliances include racks capable of supporting accessories for washing specific articles, such as silverware or bottles. A user can load the wash articles in or on the racks in predetermined manners to effectively wash or rinse the articles. Typically, the water used in washing and rinsing operations is dispensed from multiple locations to provide for multiple cleaning modes. Recently, some dishwashing appliances have incorporated specific spray assemblies to accommodate certain articles for washing that may otherwise not be properly cleaned.

For instance, users have become increasingly concerned with cleanliness of certain items, such as food items or other items for consumption. Accordingly, a demand has been established for more efficient and more thorough ways of cleaning food items, such as vegetables. Currently, handwashing vegetables can be time consuming and cumbersome, and may not provide a satisfactory level of cleanliness. Further, washing or rinsing food items within dishwashing appliances can damage the food, destroy the food, or create clogs or malfunctions within the dishwashing appliance due to food particles breaking apart.

Accordingly, a dishwashing appliance that obviates one or more of the above-mentioned drawbacks would be beneficial. Particularly, a removable basket for a dishwashing appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a basket assembly for a dishwashing appliance is provided. The basket assembly may include a basket body comprising a floor and a plurality of sidewalls extending from the floor, the basket body being removably provided within the dishwashing appliance; a receiving boss defined through the floor of the basket body, the receiving boss defining an inlet at the floor and an outlet opposite the inlet through which fluid is dispensed; and a lid selectively coupled to the basket body via a pair of latch bars, wherein the lid comprises a concave dome formed therein, and wherein the dome is located over the receiving boss such that liquid dispensed through the receiving boss is distributed within the basket via the dome.

In another exemplary aspect of the present disclosure, a dishwashing appliance is provided. The dishwasher appliance may include a tub defining a wash chamber; a pump configured to deliver a liquid to the wash chamber; a conduit in fluid communication with the pump; a variable spray assembly provided within the wash chamber, the variable spray assembly receiving the liquid from the conduit, the variable spray assembly comprising a plurality of spray tines arranged along the vertical direction; and a basket selectively received over the variable spray assembly. The basket may include a basket body comprising a floor and a plurality of sidewalls extending from the floor, the basket body being removably provided within the dishwashing appliance; a receiving boss defined through the floor of the basket, wherein the receiving boss selectively receives one of the plurality of spray tines therein; and a lid selectively coupled to the basket body via a pair of latch bars, wherein the lid comprises a dome formed therein, the dome being concave upward along the vertical direction, and wherein the dome is located over the receiving boss such that liquid dispensed through the one of the plurality of spray tines is distributed within the basket via the dome.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
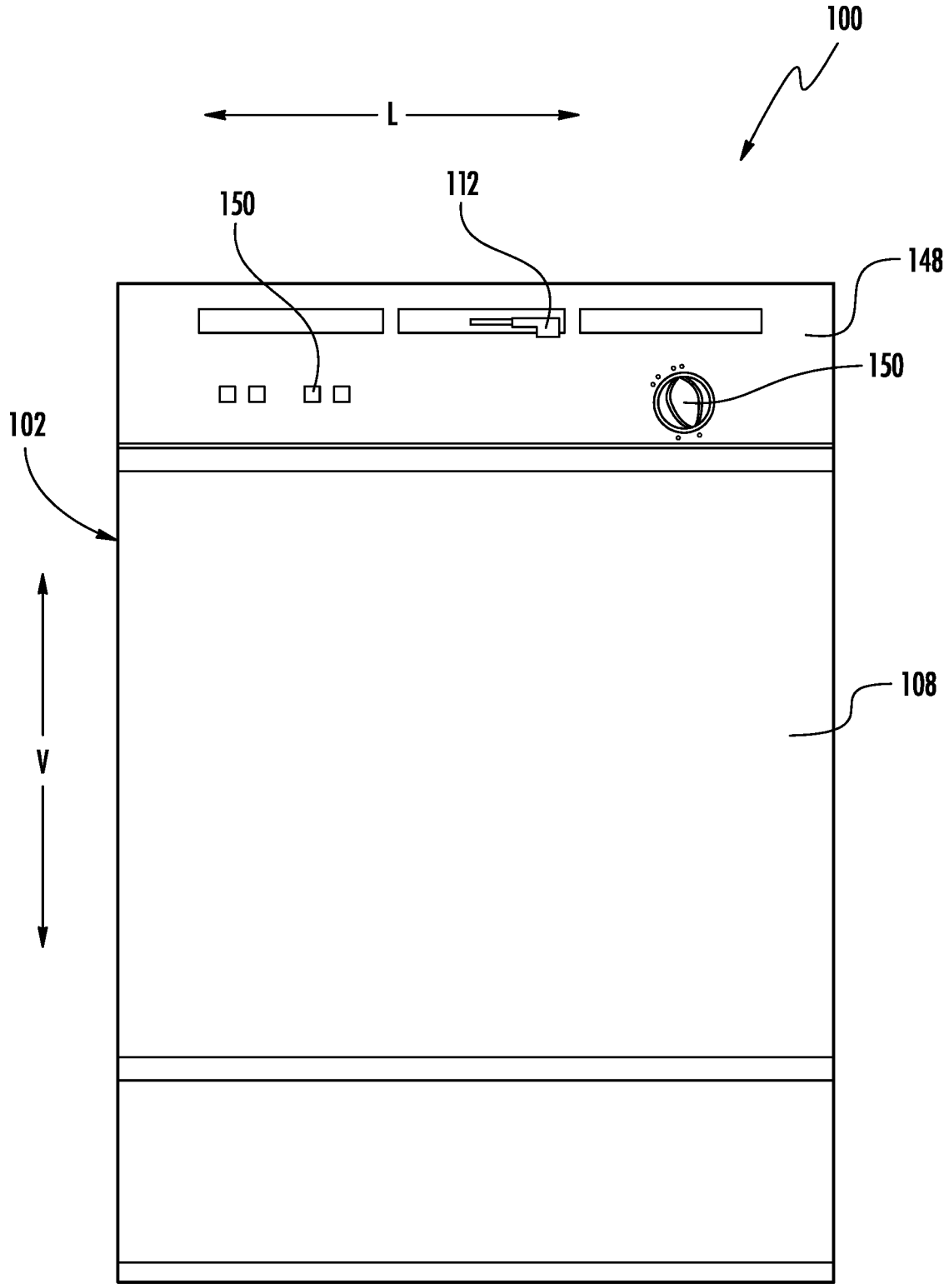
FIG. 1 provides a front elevation view of a dishwashing appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
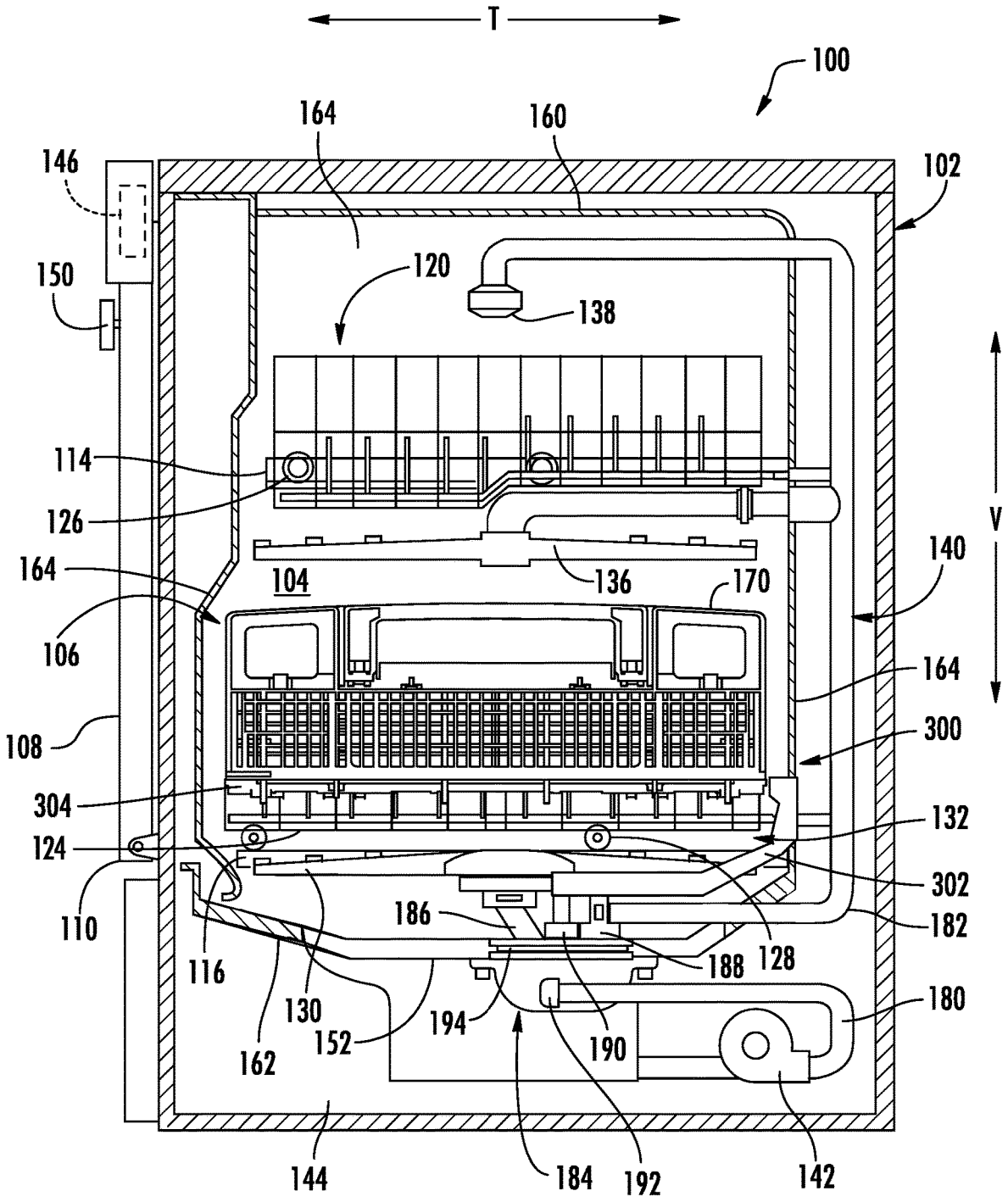
FIG. 2 provides sectional elevation view of the exemplary dishwashing appliance of FIG. 1.

Turning now to the figures, FIGS. 1 and 2 illustrate exemplary embodiments of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. Optionally, a latch 112 may be used to lock and unlock the door 108 for access to the chamber 106.

Generally, the tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. For instance, in several embodiments, the tub 104 is formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a utensil basket 170 (e.g., a silverware basket) is removably mounted to lower rack assembly 122. In additional or alternative exemplary embodiments, utensil basket 170 can be selectively or removably attached to other portions of dishwashing appliance 100 (e.g., upper rack assembly 120 or door 108). The utensil basket 170 defines one or more storage chambers and is generally configured to receive of silverware, flatware, utensils, and the like, that are too small to be accommodated by the upper and lower rack assemblies 120, 122. The utensil basket 170 may be constructed of any suitable material (e.g., metal or polymer) and define a plurality of fluid slots 178 for permitting wash fluid therethrough.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally or alternatively, each spray-arm assembly 130, 136 may include an arrangement of discharge ports or orifices for directing washing liquid onto dishes or other articles located in rack assemblies 120 and 122, which may provide a rotational force by virtue of wash fluid flowing through the discharge ports. The resultant rotation of the lower spray-arm assembly 130 provides coverage of dishes and other dishwasher contents with a spray (e.g., a spray of wash fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within the wash chamber 106.

In addition to the three spray assemblies 130, 136, 138, the appliance 100 also includes a variable jet assembly 300 disposed within the wash chamber 106. In some embodiments, the variable jet assembly 300 may remain generally stationary during use of the dishwashing appliance 100 (e.g., such that there is no intentional movement of variable jet assembly 300 outside of vibration, etc.). In additional or alternative embodiments, one or more movable nozzles (not pictured) may be provided on a manifold body 304 to rotate during use of the dishwashing appliance 100 (e.g., while manifold body 304 remains stationary).

The variable jet assembly 300 may be positioned to alternately direct wash fluid to multiple predetermined locations within the wash chamber 106 (e.g., different subsections of the wash chamber 106 or a corresponding rack 314). For instance, the variable jet assembly 300 may be disposed within wash tub 104 (e.g., on or within the lower rack assembly 122 or upper rack assembly 120) and directed toward a discrete first spray zone and second spray zone of the utensil basket 170. In exemplary embodiments, the variable jet assembly 300 may provide advantageously focused cleaning to utensils at different portions of utensil basket 170. Additionally or alternatively, delivery of wash fluid may be advantageously determined or influenced based on where utensils are within utensil basket 170. Further additionally or alternatively, delivery of wash fluid from variable jet assembly 300 may be provided without significantly blocking spray from a spray assembly (e.g., lower spray-arm assembly 130).

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly (not shown) or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Moreover, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may be direct the fluid received from the pump 142 to the variable jet assembly 300. Additionally, the diverter assembly 184 may also include a diverting valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
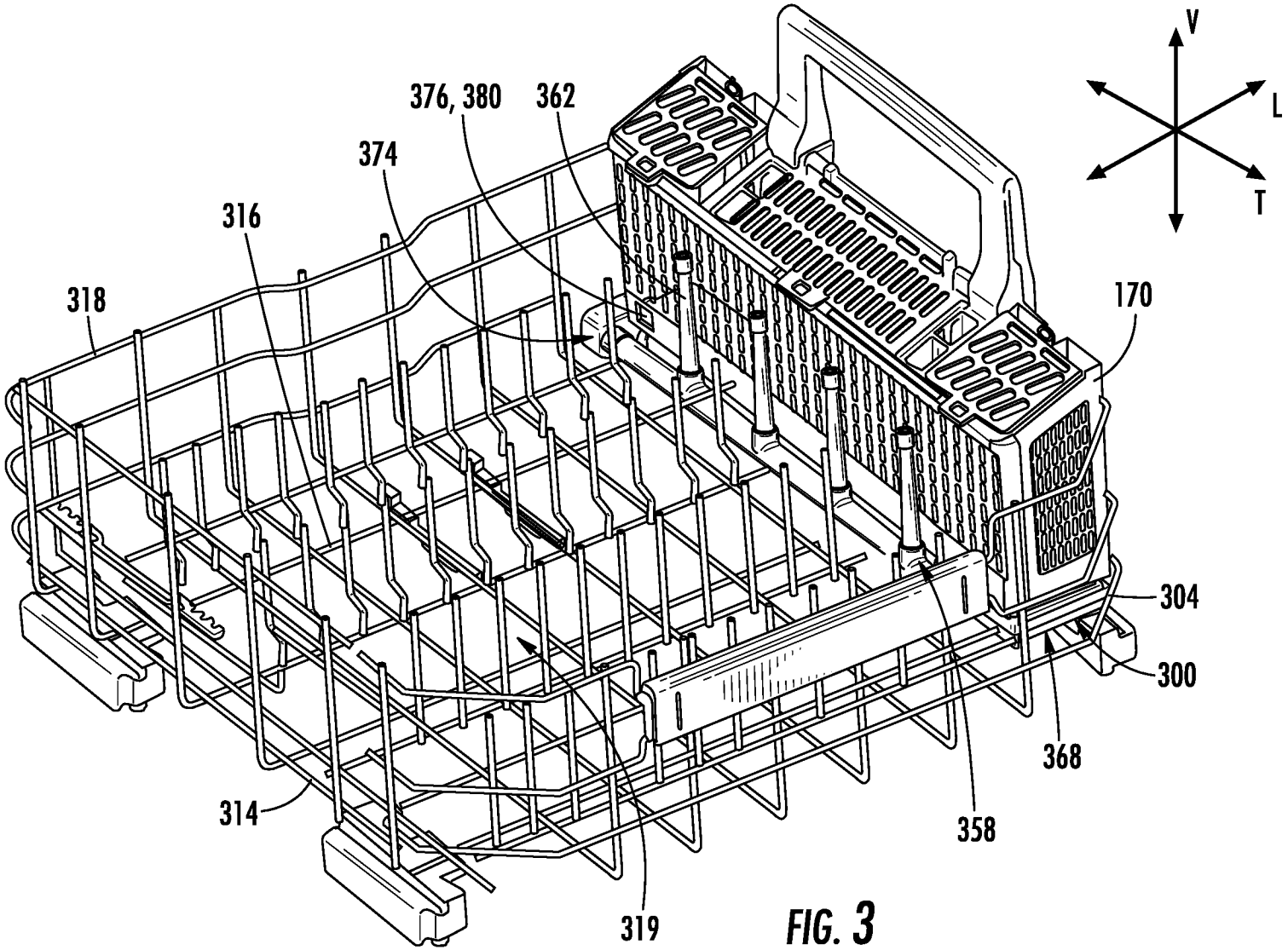
FIG. 3 provides a perspective view of several components of the exemplary dishwashing appliance of FIG. 2, including a rack assembly and variable jet assembly.
Figure 4:
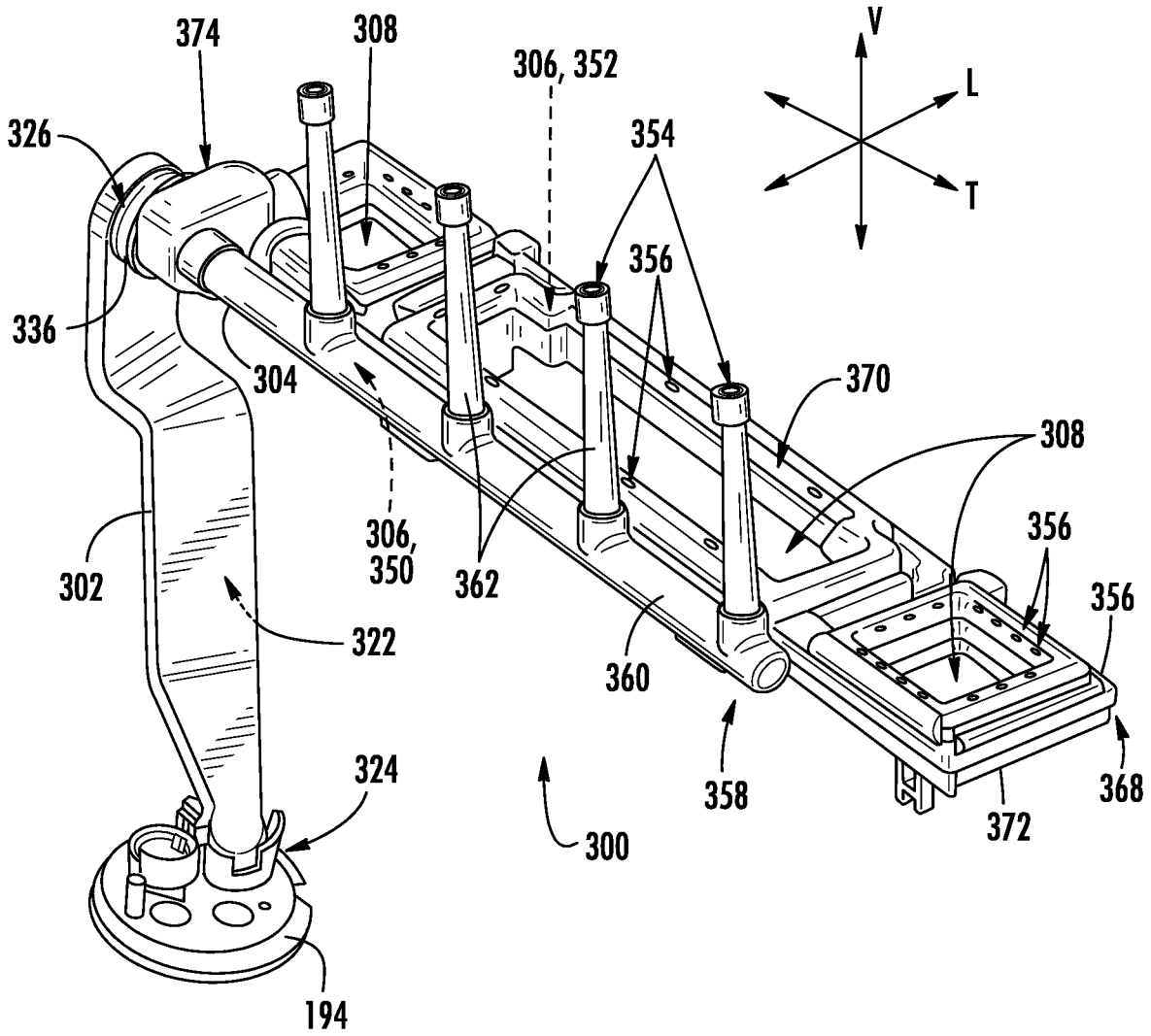
FIG. 4 provides a perspective view of the exemplary variable jet assembly of FIG. 3.

Referring now to FIGS. 3 and 4, multiple views of an exemplary embodiment of the variable jet assembly 300, including components thereof, are provided. Variable jet assembly 300 may include a fluid conduit 302 and manifold body 304 in selective fluid communication with pump 142 (FIG. 2). Generally, variable jet assembly 300 defines a discrete first spray zone and second spray zone at which water or wash fluid may be dispensed (e.g., from pump 142 or diverter assembly 184). In some embodiments, first spray zone is configured to receive one or more elongated utensils (e.g., bottles). In additional or alternative embodiments, the utensil basket 170 can be selectively positioned or mounted proximate to the variable jet assembly 300 (e.g., at second spray zone). In still other embodiments, as will be described below in further detail, a separate basket assembly may be selectively mounted to variable jet assembly 300.

As illustrated in FIGS. 3 and 4, the variable jet assembly 300 includes a manifold body 304 defining an interior passage 306 to direct wash fluid from the fluid conduit 302. The manifold body 304 may define a fluid inlet 334 upstream from an interior passage 306 that defines a separate first flow path 350 and second flow path 352. First and second flow paths 350, 352 are generally defined in fluid parallel upstream from one or more respective first spray outlet(s) 354 and second spray outlet(s) 356. During use, wash fluid may thus be directed into the wash chamber 106 from the first or second spray outlets 354, 356 (e.g., after passing into the interior passage 306 through fluid inlet 334 from the fluid conduit 302).

In some embodiments, at least a portion of the variable jet assembly 300 (e.g., the manifold body 304) is mounted to a rack assembly 314. It should be noted that the rack assembly 314 may be embodied as a lower rack assembly 122 or an upper rack assembly 120, as illustrated in FIG. 2. In turn, in some embodiments wherein the rack assembly 314 is a lower rack assembly 122, the upper rack assembly 120 will be disposed above the rack assembly 314. The rack assembly 314 may generally include a bottom wall 316 and a plurality of side walls 318 defining an interior volume or wash compartment 319 for receiving articles to be washed. Each wall 316, 318 may be formed from a lattice structure, as described above. Optionally, the wash compartment 319 may receive the manifold body 304. Additionally or alternatively, the wash compartment 319 may selectively receive the basket 170 therein.

In optional embodiments, the first spray zone is defined at a portion of manifold body 304 that includes a bottle washer assembly 358. Such a bottle washer assembly 358 may be positioned or oriented for directing a fluid from first flow path 350 towards or into rack assembly 314 through one or more first spray outlets 354 (e.g., a plurality of outlets 354 in fluid parallel with each other). In some such embodiments, bottle washer assembly 358 includes a base 360 mounted to rack assembly 314 at bottom wall 316 of rack assembly 314. Bottle washer assembly 358 may include one or more spray tines 362, each of which defining a discrete first spray outlet 354. Articles, and in particulars bottles (such as baby bottles), cups, glasses, etc., may be positioned on or over spray tines 362. Spray tines 362 are mounted to a main conduit of base 360 and can extend into the wash compartment 319 of rack assembly 314 (e.g., upwardly along the vertical direction V). In particular, spray tines 362 of bottle washer assembly 358 may be distributed between fixed tines of bottom wall 316. For example, each spray tine 362 of bottle washer assembly 358 may be positioned between respective pairs of fixed tines. Spray tines 362 may assist with supporting articles within wash compartment 319 of rack assembly 314. In addition, each spray tine 362 may emit a stream of wash fluid during operation of bottle washer assembly 358. The stream of wash fluid is directed against or onto an article positioned over or on each respective one of spray tines 362. The first spray outlet(s) 354 may thus be in fluid communication between the interior passage 306 and the wash chamber 106 (FIG. 2).

In additional or alternative exemplary embodiments, the second spray zone is defined at a portion of manifold body 304 that includes utensil basket washer assembly 368. Such a utensil basket washer assembly may be positioned or oriented for directing a fluid from second flow path 352 towards or into rack assembly 314. Utensil basket washer assembly 368 may include a nozzle having an upper face 370 and a lower face 372 that are joined together (e.g., selectively or, alternatively, fixedly) to define the second flow path 352. When assembled, upper face 370 may defining one or more second spray outlets 356 (e.g., a plurality of outlets 356 in fluid parallel with each other). Optionally, the upper face 370 and lower face 372 may extend about one or more exterior holes 308 at second spray zone. Each exterior hole 308 may extend along a central axis (e.g., parallel to the vertical direction V from the upper face 370 of the manifold body 304 to the lower face 372 of the manifold body 304. Exterior hole 308 may thus provide a void through which fluid may pass, independent of the second spray outlet(s) 356. During use, the second spray outlet(s) 356 direct a stream of wash fluid upward. For instance, the stream of wash fluid may be directed against or onto basket 170 or an article positioned over basket washer assembly 368 (e.g., separately and in fluid parallel to first spray outlet(s) 354). The second spray outlet(s) 356 may thus be in fluid communication between the interior passage 306 and the wash chamber 106 (FIG. 2).

As illustrated in FIG. 4, the fluid conduit 302 may be provided in selective fluid communication with the manifold body 304. When assembled, the fluid conduit 302 is generally disposed inside the tub 104. Specifically, the fluid conduit 302 may be fixed to the tub 104 within the wash chamber 106. In some such embodiments, the fluid conduit 302 is mounted to the tub 104 via one or more mechanical fasteners (e.g., bolts, clasps, screws, ties, etc.). The fluid conduit 302 may define a conduit passage 322 extending between a conduit inlet 324 and a conduit outlet 326 (e.g., to direct wash fluid therethrough). The conduit inlet 324 may be attached to the diverting valve 194 to selectively receive wash fluid from the pump 142 (FIG. 2), as described above. For instance, a pair of male-female tabs may be provided at the conduit inlet 324 to removably secure the fluid conduit 302 to the diverting valve 194. The conduit outlet 326 may selectively attach to the manifold body 304 (e.g., as the rack assembly 314 alternately moves in and out of wash chamber 106).

Figure 5:
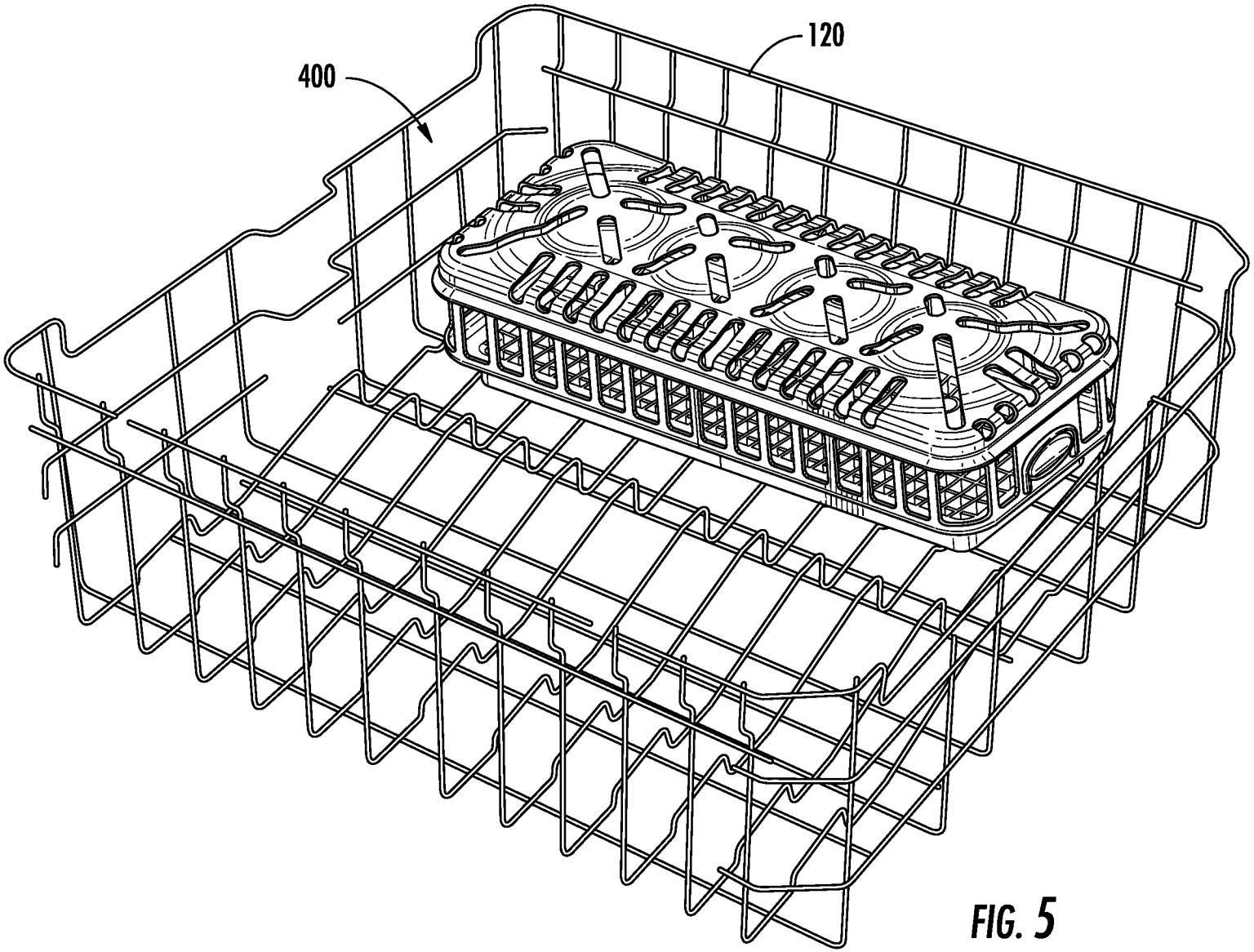
FIG. 5 provides a perspective view of the rack assembly of FIG. 3 with a removable basket attached.

Now that the variable jet assembly 300 has been described, embodiments of a basket assembly 400 configured to be selectively attached to variable jet assembly 300 will be described in detail with specific reference to FIGS. 5 through 12. For instance, basket assembly 400 may selectively receive one or more of the spray tines 362 therein to receive a flow of water or liquid from pump 142. Basket assembly 400 may rest within rack assembly 120 or 122 having spray tines 362 inserted therein. For instance, as shown in FIG. 5, basket assembly 400 may be arranged within the rack assembly adjacent to a side and on top of variable jet assembly 300 (see also FIG. 3). As will be described, basket assembly 400 may have a plurality of shapes and sizes, and the descriptions herein are for exemplary purposes. Additionally or alternatively, basket assembly 400 may be easily removable from the interior of dishwashing appliance 100.

Referring now to FIGS. 6 through 9, an exemplary embodiment of basket assembly 400 will be described. Basket assembly 400 may include a basket body 402. Basket body 402 may be predominantly hexahedral in shape. For instance, basket body 402 may include a plurality of sidewalls forming a cavity. The plurality of sidewalls may include a first lateral sidewall 404, a second lateral sidewall 406, a first transverse sidewall 408, a second transverse sidewall 410, and a floor 412. Each of the plurality of sidewalls may be formed from a lattice-style structure. For instance, each of the plurality of sidewalls may be considered skeletal, forming a frame including a plurality of through holes. Thus, liquid supplied to the cavity may easily drain from basket body 402. An interior of basket body 402 may have a plurality of curved or filleted intersection points. For instance, a junction of each of the plurality of sidewalls and floor 412 may be curved or filleted to induce water and debris to flow toward the lattice structure of floor 412, increasing drainage.

According to at least one embodiment, basket body 402 may include a base 414. Base 414 may extend from a bottom of floor 412 (e.g., along the vertical direction V). Accordingly, base 414 may be considered an extension of floor 412. Further, floor 412 may define a first perimeter. The first perimeter may be an outer edge of floor 412. Base 414 may define a second perimeter. The second perimeter may be an outer edge of base 414. According to at least one embodiment, the first perimeter is larger than the second perimeter. Thus, an overhang or undercut 424 may be formed between the perimeter of floor 412 and one or more sidewalls of base 414 (e.g., as a bottom of the plurality of sidewalls forming the cavity). Advantageously, a user may easily grab basket assembly 400 via the overhang 424.

Figure 9:
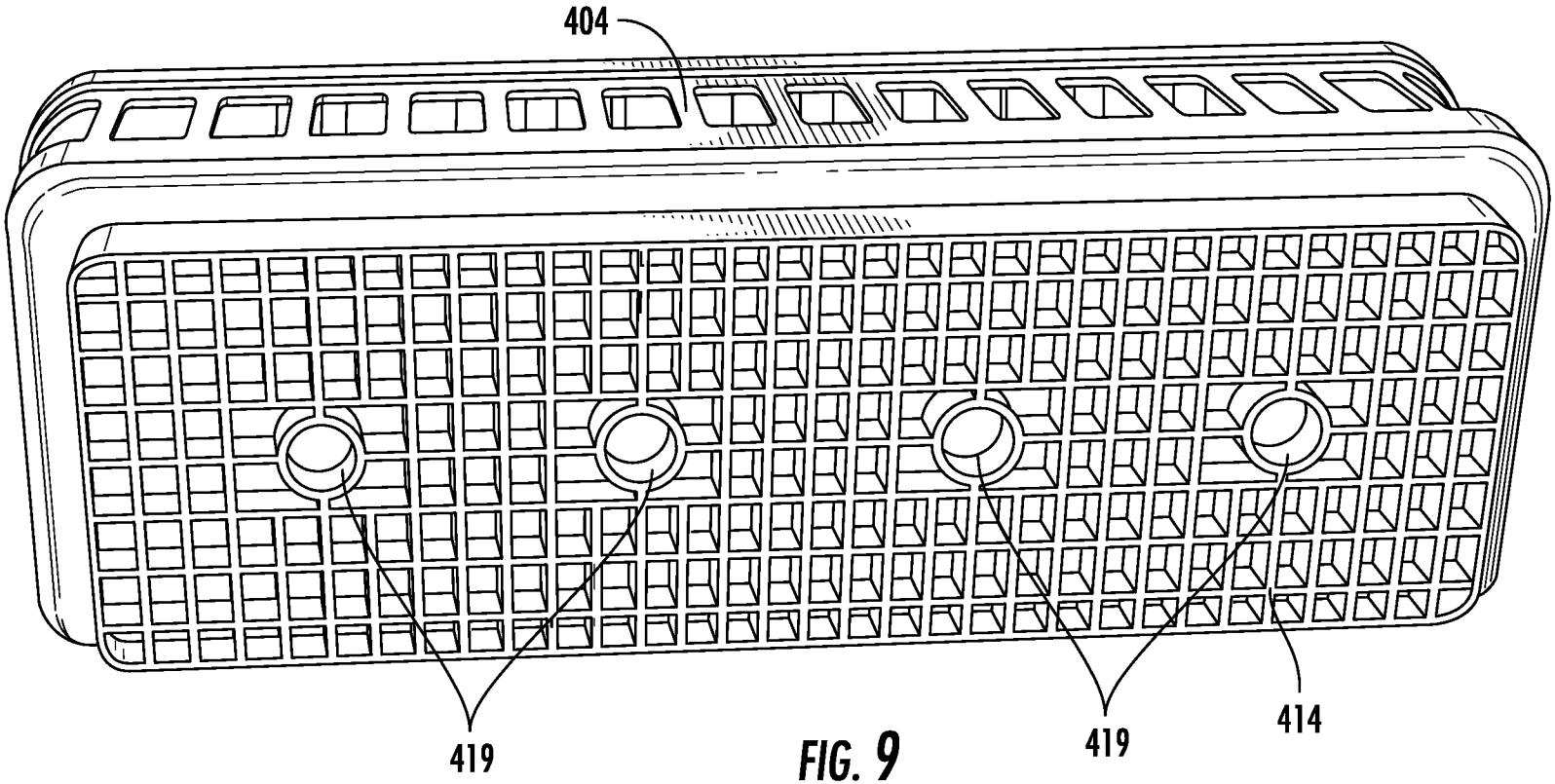
FIG. 9 provides a bottom view of the removable basket of FIG. 6.

Base 414 and floor 412 may together define a grate or grating as a bottom of basket body 402. For instance, a plurality of intersecting vertical walls may form the grate (e.g., as seen in FIG. 9). The gaps formed between the intersecting walls may have a predetermined cross-section width such that certain larger items (e.g., food items) placed within the cavity do not fall through floor 412. In some embodiments, the predetermined cross-section width of each gap is between about ¾" and about ½". Thus, water and small debris may be flushed through floor 412 and base 414 while larger items remain within basket body 402.

The first and second lateral sidewalls 404, 406 may be longer than the first and second transverse sidewalls 408, 410. It should be understood that the reference to "lateral" and "transverse" are for description purposes only, and that the orientation of the sidewalls may be adjusted according to specific embodiments. The first and second lateral sidewalls 404, 406 may be longer than the first and second transverse sidewalls 408, 410. Thus, a transverse length 407 may be longer than a lateral length 411 of basket body 402.

Figure 8:
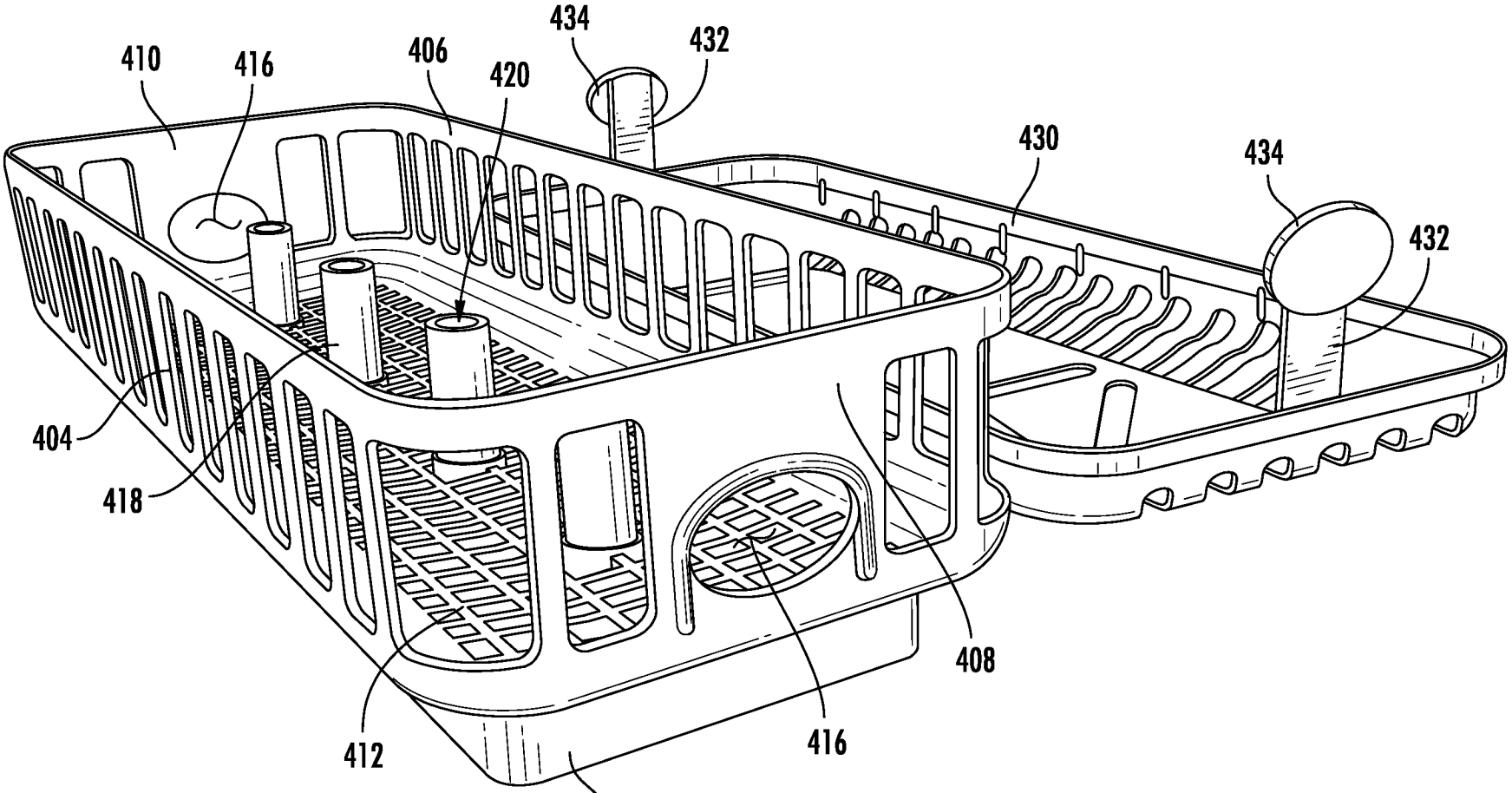
FIG. 8 provides a perspective view of the removable basket of FIG. 6 with the lid removed from the body.

Each of first and second transverse sidewalls 408, 410 may include an aperture 416 formed therein. With reference to FIG. 8, first transverse sidewall 408 will be described. It should be understood that the description applies to second transverse sidewall 410 as well. Aperture 416 may be predominantly oval shaped and may be formed through first transverse sidewall 408 (e.g., along the transverse direction). Aperture 416 may be generally centrally located on first transverse sidewall 408 (e.g., along the lateral direction L). Aperture 416 may be configured to selectively receive a latch bar (described in more detail below).

Basket body 402 may include one or more receiving bosses 418. For instance, the one or more receiving bosses 418 may protrude from floor 412 along the vertical direction V (e.g., within the cavity formed by the plurality of sidewalls). Hereinafter, a single receiving boss 418 will be described with the understanding that the description applies to each receiving boss 418. In detail, receiving boss 418 may be configured to fit over spray tine 362 of variable jet assembly 300. Thus, a diameter of receiving boss 418 may be larger than a diameter of spray tine 362. Moreover, receiving boss 418 may form a through hole allowing the cavity of basket body 402 to fluidly communicate with an external space (e.g., chamber 106). For instance, with reference to FIG. 9, each of the plurality of receiving bosses 418 may form an inlet 419 defined in base 414. Thus, spray tine 362 may penetrate floor 412 via inlet 419.

Figure 7:
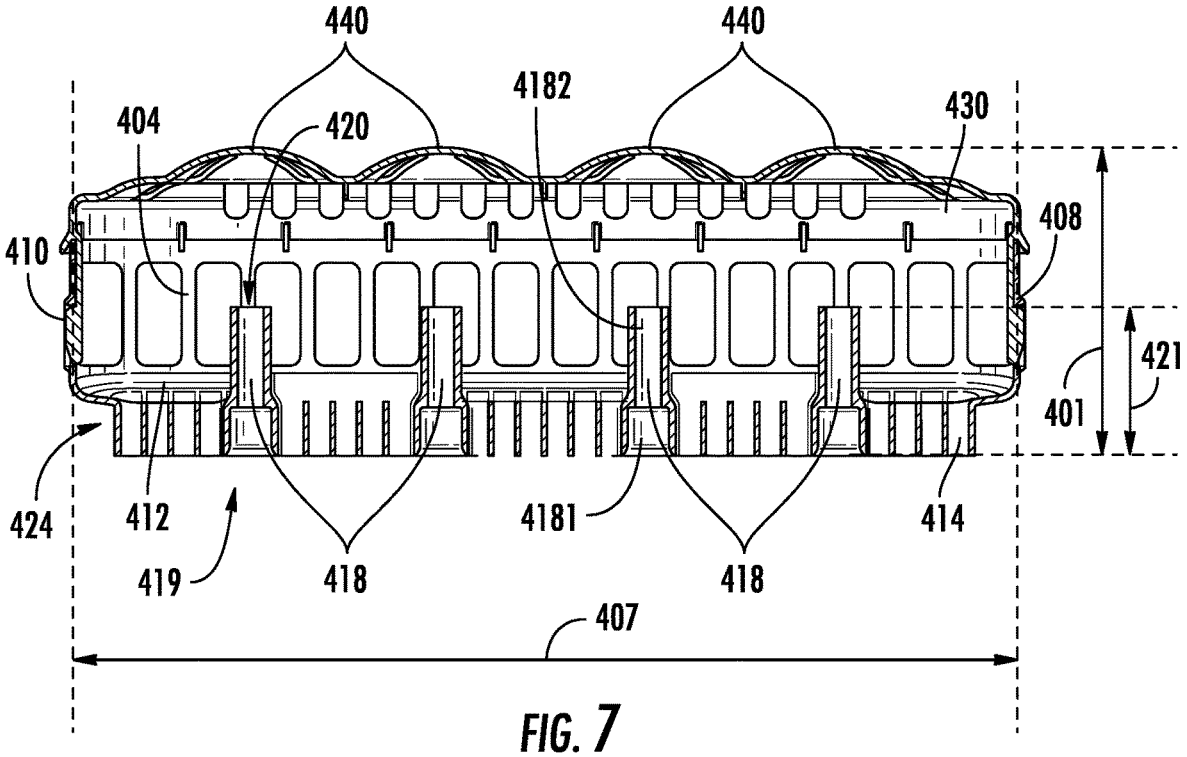
FIG. 7 provides a side section view of the removable basket of FIG. 6.

Receiving boss 418 may include a base portion 4181 and a sleeve portion 4182. As described above, receiving boss 418 may selectively receive spray tine 362 therein (e.g., in the installed position). In some embodiments, spray tine 362 includes a taper at or near a bottom portion thereof. In detail, a diameter of spray tine 362 may be wider at a bottom or base portion (e.g., connected to base 360). Accordingly, a diameter (or width) of base portion 4181 of receiving boss 418 may be larger than a diameter (or width) of sleeve portion 4182. As shown in FIG. 7, base portion may be provided in base 414 of basket body 402. Base portion 4181 may be integral with base 414, or may be a separate piece attached to base 414. Base portion 4181 may be predominantly cylindrical in shape. However, base portion 4181 may have any suitable shape so as to accommodate spray tine 362 therein.

Sleeve portion 4182 may extend from base portion 4181 (e.g., along the vertical direction V). As shown in FIG. 7, sleeve portion may be provided above base portion 4181 along the vertical direction V, within the cavity of basket body 402. As described above, the diameter or width of sleeve portion 4182 may be less than the diameter or width of base portion 4181. In some embodiments, the extension length of sleeve portion 4182 is approximately equal to the extension length of spray tine 362. Additionally or alternatively, the extension length of sleeve portion 4182 may be less than or greater than the extension length of spray tine 362.

Receiving boss 418 may have an axial length extending into the cavity of basket body 402. Referring briefly to FIG. 7, the axial length may be parallel to the vertical direction V. A base of receiving boss 418 may be provided within base 414. Receiving boss 418 may thus extend upward into the cavity. For example, the extending height 421 of receiving boss 418 may be between about 45% and about 55% of a total height 401 of basket assembly 400. Accordingly, the entire height of spray tine 362 may be received within receiving boss 418 (e.g., within sleeve portion 4182). Additionally or alternatively, receiving boss 418 may form an outlet 420 opposite inlet 419. For instance, outlet 420 may be defined at a top of receiving boss 418 along the vertical direction V. In detail, outlet 420 may be defined at the top of sleeve portion 4182. Water or liquid dispensed from spray tine 362 may exit receiving boss 418 via outlet 420. Moreover, the top of sleeve portion 4182 (e.g., outlet 420) may be horizontally flat. Accordingly, the water or liquid dispensed from spray tine 362 may be dispensed along the vertical direction V.

As described above, a plurality of receiving bosses 418 may be provided. According to one example, e.g., as shown in FIG. 7, four receiving bosses 418 are provided. Thus, each of the spray tines 362 may be accepted within a respective receiving boss 418. However, more or fewer receiving bosses 418 may be incorporated as certain embodiments dictate. Further, the plurality of receiving bosses 418 may be spaced evenly apart within the cavity of basket body 402. For instance, the plurality of receiving bosses 418 may be spaced apart along the transverse direction T. Additionally or alternatively, the extending height 421 of receiving boss 418 may vary according to specific embodiments. For instance, the extending height 421 of receiving boss 418 may be less than about 45% of the total height 401 or may be greater than about 55% of the total height 401. Moreover, each of the receiving bosses 418 may have a different height. It should be understood that variations to the height and number of receiving bosses 418 is within the scope of the present disclosure.

Figure 6:
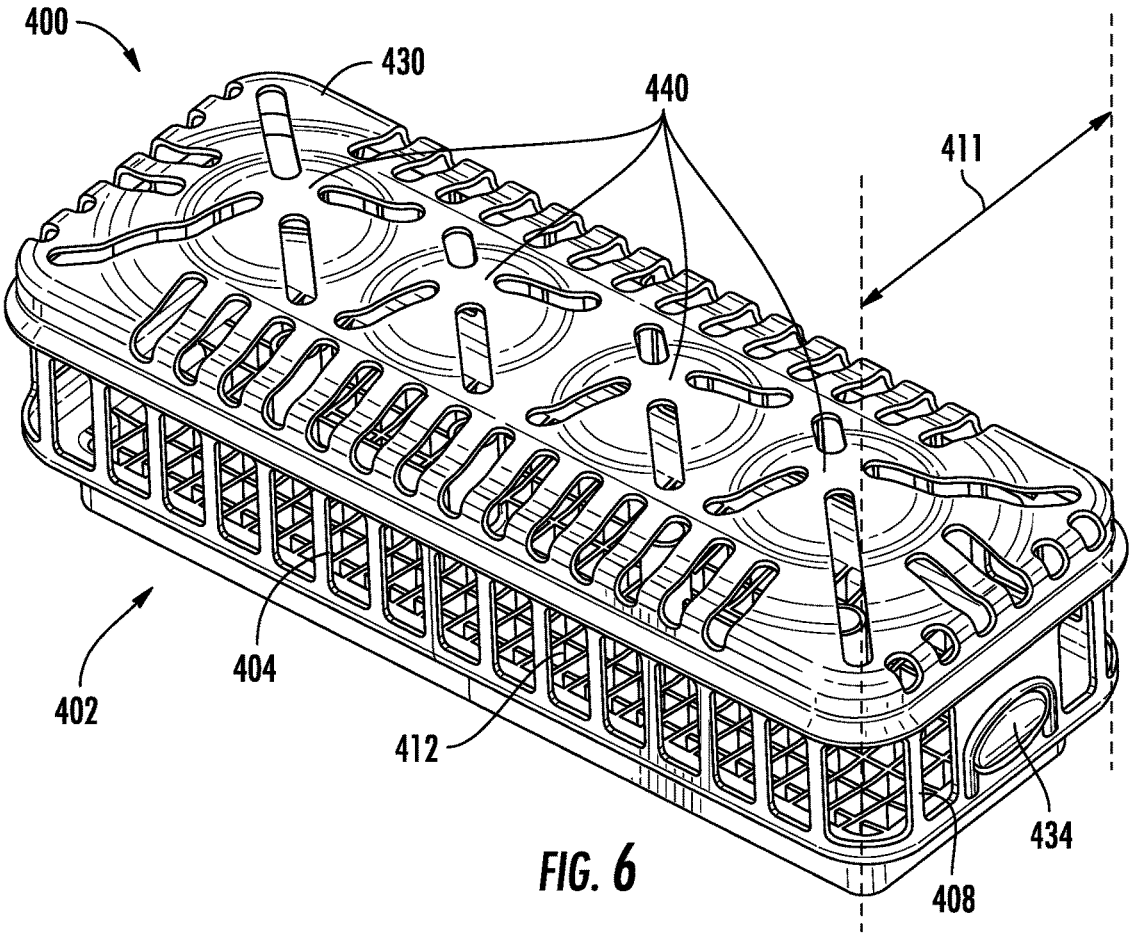
FIG. 6 provides a perspective view of the removable basket of FIG. 5.

Basket assembly 400 may include a lid 430 selectively coupled to basket body 402. With reference to FIGS. 6 through 8, an exemplary embodiment of lid 430 will be described. Lid 430 may be removably coupled to basket body 402. For instance, lid 430 may include a pair of latch bars 432 extending along the vertical direction V (e.g., when lid 430 is attached to basket body 402). FIG. 8 shows lid 430 in a detached position, placed upside-down next to basket body 402. Hereinafter, a single latch bar 432 will be described in detail with the understanding that the description will apply to each latch bar 432.

Lid 430 may include one or more concave domes (or dome features) 440 formed therein. For instance, with reference to FIGS. 6 and 7, concave dome 440 is formed into lid 430 above receiving boss 418 along the vertical direction V. According to at least one example, concave dome 440 is concave upward along the vertical direction V (e.g., such that a portion of lid 430 is concave when viewed from receiving boss 418). When water or liquid is dispensed from spray tine 362 and exits outlet 420 of receiving boss 418, the relatively powerful jet may strike concave dome 440 and disperse throughout the cavity of basket body 402. Advantageously, food items or other delicate items placed within the cavity may not be damaged by water jets but be gently bathed in a low velocity shower of water from concave dome 440. In detail, concave dome 440 may in effect create a cascade of water that falls over a greater area within basket body 402. The water may thus be more dispersed over a greater area as compared to a jet, offering more rinsing ability. The number of concave domes 440 may be equal to the number of receiving bosses 418, such that each receiving boss 418 is positioned beneath a concave dome 440.

The spherical concavity of concave dome 440 may vary according to embodiments. For instance, concave dome 440 may have a constant spherical arc therethrough. Additionally or alternatively, a concave dome 440 may form a varying spherical arc. In some embodiments, concave dome 440 is concave downward along the vertical direction V (e.g., convex toward receiving boss 418). In still other embodiments, concave dome 440 includes a flat portion at a top dead center thereof. It should be understood that minor variations to the design and construction of concave dome 440 is within the purview of this disclosure.

Lid 430 may further include one or more apertures formed therethrough. In detail, similar to basket body 402 (e.g., the plurality of sidewalls), lid 430 may have a lattice structure (or skeletal structure) such that water or liquid may easily exit basket body 402. As shown in FIG. 6, some of the apertures may extend through concave dome 440. Thus, some of the water or liquid dispensed from spray tine 362 and receiving boss 418 may pass through the apertures (e.g., apertures formed within concave dome 440). Accordingly, items placed within basket assembly 400 may not be flooded or damaged from oversaturation.

As described above, the pair of latch bars 432 may extend along the vertical direction V from lid 430. According to this embodiment, latch bar 432 extends from a transverse end of lid 430. As shown in FIG. 8, latch bar 432 may extend a predetermined distance from lid 430. Latch bar 432 may be configured to interact with aperture 416 of first transverse sidewall 408 (and/or second transverse sidewall 410).

In detail, latch bar 432 may include a latch 434 at a distal end thereof. Latch 434 may be shaped commensurate to aperture 416. For example, when aperture 416 is predominantly oval shaped, latch 434 is also predominantly oval shaped. Accordingly, when lid is latched to basket body 402, latch 434 may be selectively inserted into aperture 416 to couple lid 430 to basket body 402. Latch bar 432 may be flexible (e.g., relative to lid 430). In detail, a user may press latch 434 toward an interior of basket body 402 (e.g., the cavity of basket body 402) to selectively release lid 430 from basket body 402. Therefore, lid 430 may be selectively removed completely from basket body 402. As mentioned above, each of the pair of latch bars 432 may include a latch 434, as would be understood.

Figure 10:
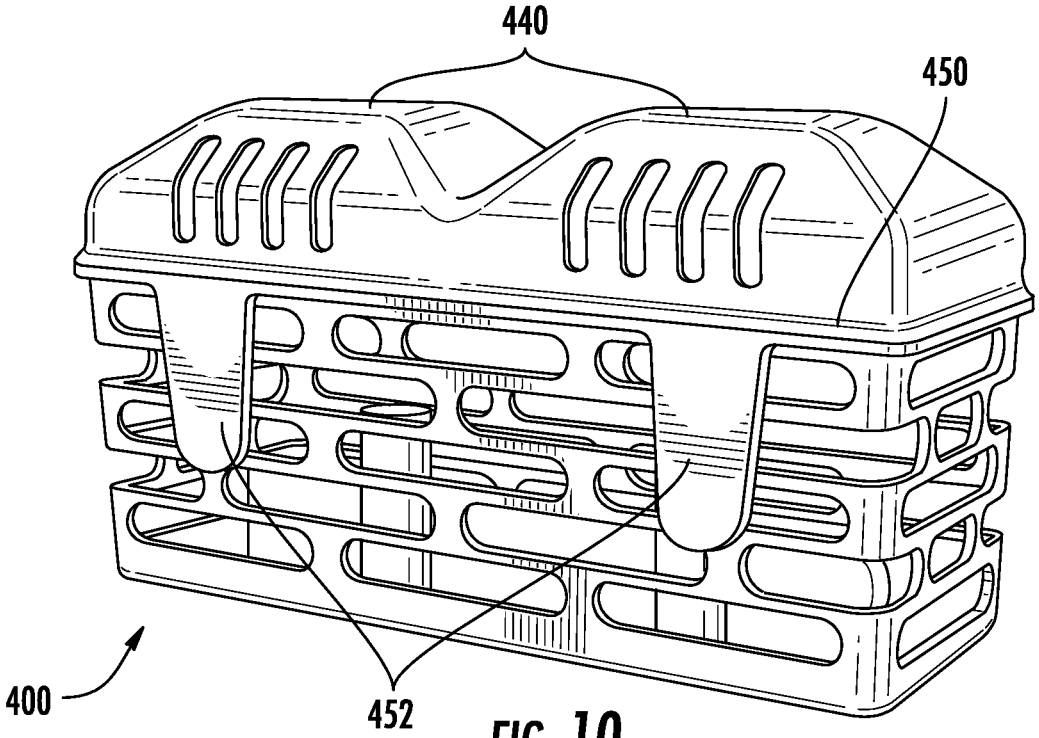
FIG. 10 provides a perspective view of another exemplary removable basket.
Figure 11:
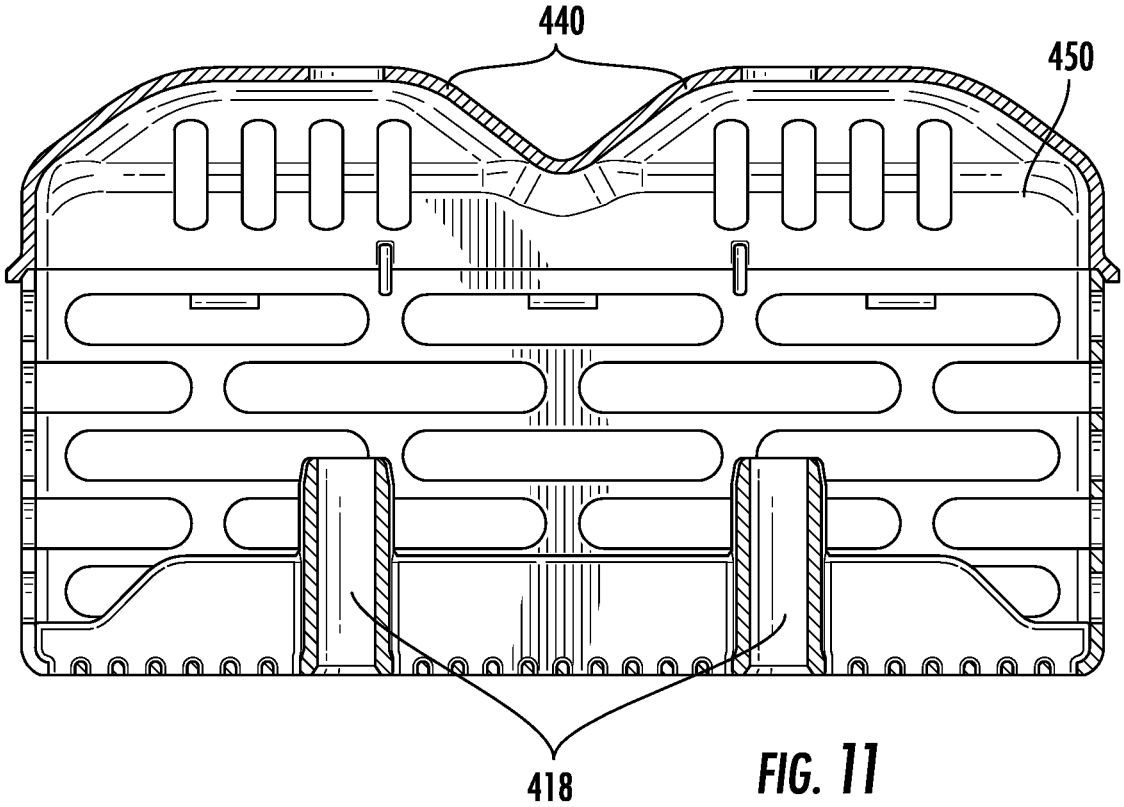
FIG. 11 provides a side section view of the removable basket of FIG. 10.
Figure 12:
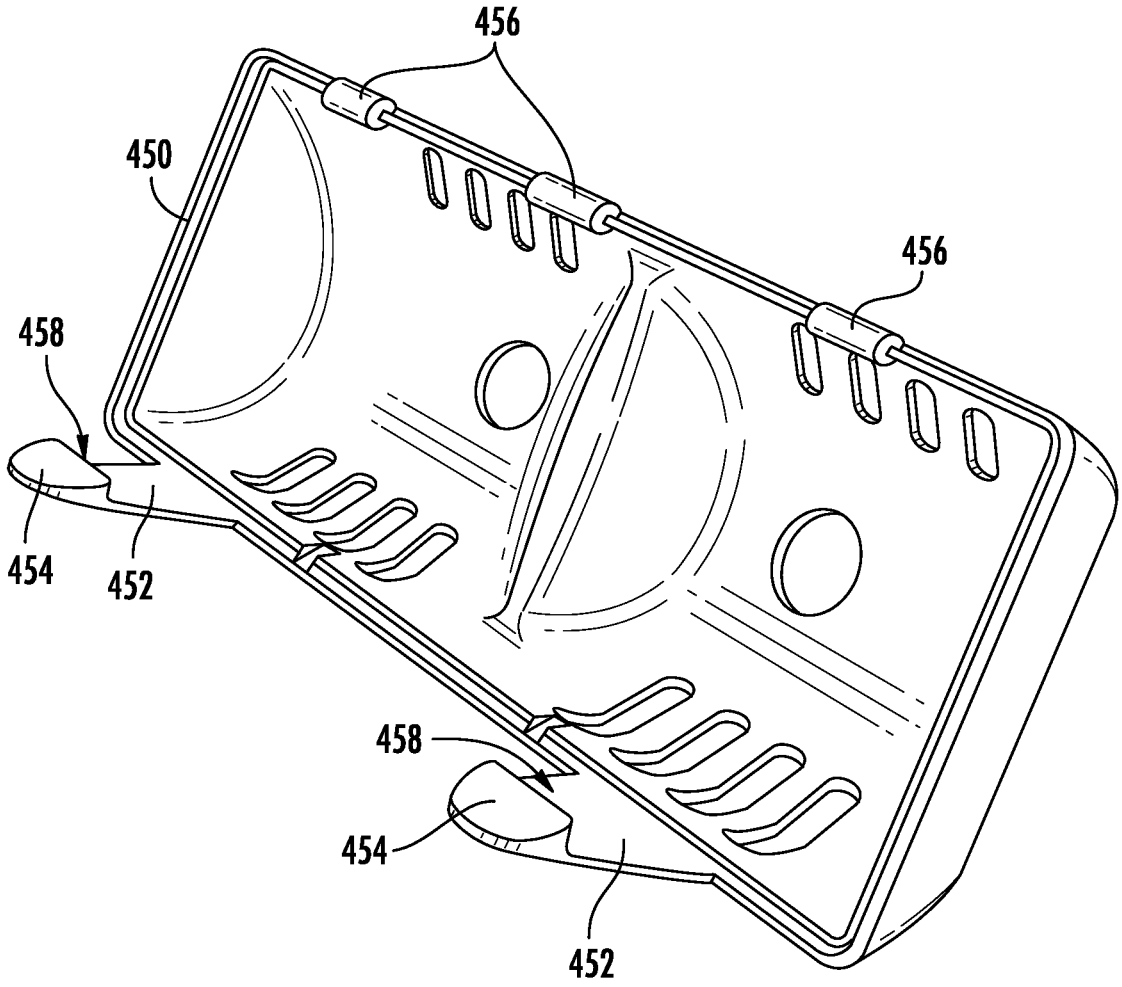
FIG. 12 provides a perspective view of the lid of the removable basket of FIG. 10 removed from the basket body.

Another exemplary embodiment of the present disclosure will not be discussed with reference to FIGS. 10 through 12. Like features will be referred to with like reference numerals, with the differences pointed out herein. According to another exemplary embodiment, basket assembly 400 includes the basket body 402. Basket body 402 includes the plurality of sidewalls including first and second lateral sidewalls 404, 406, and first and second transverse sidewalls 408, 410, as well as floor 412. Similar to the above-described embodiment, each of the plurality of sidewalls and floor 412 may have a lattice or skeletal structure including a plurality of apertures through which water or liquid main drain. One or more receiving bosses 418 may extend from floor 412. According to the embodiment, two receiving bosses 418 are formed. Receiving bosses 418 are similar to those described above, and thus a repeat description will be omitted for the sake of brevity.

Basket assembly 400 may include a lid 450. Lid 450 may be rotatably attached to basket body 402. For instance, lid 450 may include one or more hinges 456 provided on a lateral edge thereof. Hereinafter, a single hinge 456 will be described with the understanding that the description applies to each hinge 456. Hinge 456 may be selectively attached to first or second lateral sidewall 404, 406. For instance, hinge 456 may be a clip extending from lid 450 along the vertical direction V. The clip may be C-shaped and may curl about the lateral edge of lid 450. Accordingly, hinge 456 may be selectively coupled to a lattice feature of first or second lateral sidewall 404, 406. In detail, hinge 456 may partially wrap around the lattice feature to allow lid 450 to rotate with respect to the lattice feature. In some implementations, the partial wrap allows lid 450 to be easily removed from basket body 402, e.g., to avoid basket assembly 400 from tipping over when empty.

Lid 450 may include a pair of latch bars 452. According to the embodiment, each of the pair of latch bars 452 may extend from a lateral edge of lid 450 (i.e., an opposite lateral edge from a location of hinge 456). As shown in FIG. 10, the pair of latch bars 452 may be spaced apart along the transverse direction T. Further, each of the pair of latch bars 452 may extend downward along the vertical direction V (e.g., when the lid is in an attached position). Thus, a user may detach each of the plurality of latches 452 to rotate lid 450 with respect to basket body 402, thereby allowing access to a cavity formed by the plurality of sidewalls. Hereinafter, a single latch bar 452 will be described.

Latch bar 452 may include a latch 454. Latch 454 may be a protrusion protruding from a distal end of latch bar 452, e.g., toward basket body 402. For instance, latch 454 may have a triangular cross section (e.g., along the transverse direction T). A top end 458 of latch 454 may extend further toward basket body 402 from latch bar 452 than a bottom end 450 of latch 454. Thus, when lid 450 is moved toward the attached position, latch 454 may ramp over a lattice feature of one of the plurality of sidewalls e.g., second lateral sidewall 406, and snap into an aperture formed through second lateral sidewall 406. To unhook latch 454 from the aperture, the user may pull latch bar 452 away from second lateral sidewall 406 and rotate lid 450 about hinge 456.

The basket assembly described herein provides a way to easily rinse vegetables or other delicate items within a dishwashing appliance, particularly utilizing vertical spray tines. The basket may include a plurality of lattice walls to allow fluid to easily drain therefrom. The basket may be easily removable from the dishwashing appliance so as to move the basket from the dishwashing assembly to a sink or to a refrigerator appliance. The basket may include one or more receiving bosses formed therein. The receiving bosses may selectively receive spray tines (e.g., vertical spray tines) therein, through which water may be dispensed. The basket assembly may include a lid having one or more domes or dome features. The dome features may be concave and may be positioned above the receiving bosses (for example, one dome per receiving boss). Accordingly, water dispensed from the spray tines via the receiving bosses may contact the domes. The water may then be dispersed throughout an interior of the basket assembly to gently rinse items within the basket. A first lid may be removable from a basket body via a push button latch on either end of the basket. A second lid may be rotatable with respect to the basket body. Advantageously, delicate items and food such as vegetables may be easily and thoroughly cleaned without suffering damage from high pressure water jets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A basket assembly for a dishwashing appliance, the dishwashing appliance defining a vertical direction, a lateral direction, and a transverse direction, the basket comprising:

a basket body comprising a floor and a plurality of sidewalls extending from the floor, wherein the plurality of sidewalls defines at least two apertures, the basket body being removably provided within the dishwashing appliance;

a receiving boss defined through the floor of the basket body, the receiving boss defining an inlet at the floor and an outlet opposite the inlet through which fluid is dispensed; and a lid selectively coupled to the basket body via a pair of latch bars at least partially received by the at least two apertures, wherein the lid comprises a concave dome formed therein, and wherein the dome is located over the receiving boss such that liquid dispensed through the receiving boss is distributed within the basket via the dome.

2. The basket of claim 1, wherein the plurality of sidewalls comprises:

a pair of opposing lateral sidewalls; and a pair of opposing transverse sidewalls, each of the pair of opposing transverse sidewalls comprising an aperture of the at least two apertures.

3. The basket of claim 2, wherein each of the pair of latch bars comprises a latch selectively received within the aperture.

4. The basket of claim 2, wherein the basket body comprises a base, and wherein a perimeter of the base is smaller than a perimeter of the floor so as to form an overhang between the perimeter of the floor and a sidewall of the base.

5. The basket of claim 1, wherein the receiving boss comprises a plurality of receiving bosses spaced evenly apart along the transverse direction, and wherein the dome comprises a plurality of domes, each of the plurality of domes being positioned directly over one of the plurality of receiving bosses along the vertical direction.

6. The basket of claim 5, wherein the receiving boss protrudes from the floor, and wherein a height of each of the plurality of receiving bosses along the vertical direction is between 45% and 55% of a total height of the basket body.

7. The basket of claim 1, wherein the lid is rotatable with respect to the basket body, the lid comprising:

a hinge provided on a first lateral edge of the lid, wherein the pair of latch bars extend from a second lateral edge of the lid opposite the first lateral edge along the vertical direction when the lid is in a closed position.

8. The basket of claim 7, wherein each latch of the pair of latch bars comprises a latch protruding from a distal end of each latch bar toward the basket body when the lid is in the closed position.

9. The basket of claim 1, wherein the floor and each of the plurality of sidewalls comprise a lattice structure.

10. The basket of claim 1, wherein the basket is accommodated within a top rack of the dishwashing appliance.

11. A dishwashing appliance defining a vertical direction, a lateral direction, and a transverse direction, the dishwasher appliance comprising:

a tub defining a wash chamber;

a pump configured to deliver a liquid to the wash chamber;

a conduit in fluid communication with the pump;

a variable spray assembly provided within the wash chamber, the variable spray assembly receiving the liquid from the conduit, the variable spray assembly comprising a plurality of spray tines arranged along the vertical direction; and a basket selectively received over the variable spray assembly, wherein the basket comprises:

a basket body comprising a floor and a plurality of sidewalls extending from the floor, the basket body being removably provided within the dishwashing appliance;

a receiving boss defined through the floor of the basket, wherein the receiving boss selectively receives a spray tine of the plurality of spray tines therein; and a lid selectively coupled to the basket body at least one sidewall of the plurality of sidewalls defining at least one aperture, wherein at least one latch bar of a pair of latch bars is selectively received within the at least one aperture, wherein the lid comprises a dome formed therein, the dome being concave upward along the vertical direction, and wherein the dome is located over the receiving boss such that liquid dispensed through the spray tine of the plurality of spray tines is distributed within the basket via the dome.

12. The dishwashing appliance of claim 11, wherein the plurality of sidewalls comprises:

a pair of opposing lateral sidewalls; and a pair of opposing transverse sidewalls, each of the pair of opposing transverse sidewalls comprising an aperture.

13. The dishwashing appliance of claim 12, wherein each of the pair of latch bars comprises a latch selectively received within the aperture.

14. The dishwashing appliance of claim 12, wherein the basket body comprises a base, and wherein a perimeter of the base is smaller than a perimeter of the floor so as to form an overhang between the perimeter of the floor and a sidewall of the base.

15. The dishwashing appliance of claim 11, wherein the receiving boss comprises a plurality of receiving bosses spaced evenly apart along the transverse direction, and wherein the dome comprises a plurality of domes, each of the plurality of domes being positioned directly over one of the plurality of receiving bosses along the vertical direction.

16. The dishwashing appliance of claim 15, wherein a height of each of the plurality of receiving bosses along the vertical direction is between 45% and 55% of a total height of the basket body.

17. The dishwashing appliance of claim 11, wherein the lid is rotatable with respect to the basket body, the lid comprising:

a hinge provided on a first lateral edge of the lid, wherein the pair of latch bars extend from a second lateral edge of the lid opposite the first lateral edge along the vertical direction when the lid is in a closed position.

18. The dishwashing appliance of claim 17, wherein each latch of the pair of latch bars comprises a latch protruding from a distal end of each latch bar toward the basket body when the lid is in the closed position.

19. The dishwashing appliance of claim 11, wherein the floor and each of the plurality of sidewalls comprise a lattice structure.

20. The dishwashing appliance of claim 11, wherein the basket is accommodated within a top rack of the dishwashing appliance.

* * * * *